US007793883B2

(12) United States Patent
Kinugasa et al.

(10) Patent No.: US 7,793,883 B2
(45) Date of Patent: Sep. 14, 2010

(54) TRANSFER TOOL

(75) Inventors: Shuji Kinugasa, Osaka (JP); Hideto Shima, Kyoto (JP)

(73) Assignee: Kokuyo Co., Ltd., Osaka-shi, Osaka (JP)

( * ) Notice: Subject to any disclaimer, the term of this patent is extended or adjusted under 35 U.S.C. 154(b) by 7 days.

(21) Appl. No.: 12/219,042

(22) Filed: Jul. 15, 2008

(65) Prior Publication Data

US 2009/0026302 A1 Jan. 29, 2009

(30) Foreign Application Priority Data

Jul. 27, 2007 (JP) ..... P2007-196637

(51) Int. Cl.
*B65D 85/02* (2006.01)

(52) U.S. Cl. ..... 242/588.6; 242/538.3; 118/257

(58) Field of Classification Search ..... 242/588.6, 242/598.5–598.6, 538.3, 423, 423.1–423.2
See application file for complete search history.

(56) References Cited

U.S. PATENT DOCUMENTS

| | | | | |
|---|---|---|---|---|
| 5,792,263 | A | 8/1998 | Koyama | |
| 6,500,259 | B1 * | 12/2002 | Tamai et al. | 118/76 |
| 7,325,583 | B2 * | 2/2008 | Watanabe | 156/527 |
| 2006/0090857 | A1 * | 5/2006 | Watanabe | 156/577 |

FOREIGN PATENT DOCUMENTS

| | | | |
|---|---|---|---|
| EP | 1067075 | A2 | 1/2001 |
| JP | 08-142462 | A | 6/1996 |
| JP | 2001-71689 | | 3/2001 |
| JP | 2002-104718 | A | 4/2002 |
| JP | 2005-28670 | | 2/2005 |

* cited by examiner

*Primary Examiner*—Sang Kim
(74) *Attorney, Agent, or Firm*—McGinn IP Law Group, PLLC

(57) ABSTRACT

The present invention provides a transfer tool comprising a refill which has a supply reel and a winding reel around which a transfer tape is wound and which hold the transfer tool, and a support plate which rotatably supports the supply reel and the winding reel, a stopping member is provided between the supply reel and the support plate such that the stopping member can be inserted and pulled out, and rotation of the supply reel or the winding reel is suppressed when the stopping member is disposed at a predetermined inserting position.

20 Claims, 10 Drawing Sheets

TRANSFER TOOL

BACKGROUND OF THE INVENTION

1. Field of the Invention

The present invention relates to a transfer tool having a refill including a supply reel and a winding reel around which a transfer tape is wound and which holds the transfer tape, and a support plate which rotatably supports the supply reel and the winding reel.

2. Background of the Related Art

Conventionally, there is widely used a transfer tool having a refill including a supply reel and a winding reel around which a transfer tape is wound and which holds the transfer tape, and a support plate which rotatably supports the supply reel and the winding reel, in which the refill is detachably attached to a case. In such a transfer tool, since the refill can be replaced when the entire transfer tape is wound around the winding reel, not only the refill attached to the case is in circulation, but a replacement refill is also in circulation widely. When the replacement refill is alone put into circulation, heretofore, the supply reel or the winding reel is rotated unnecessarily during transportation, and in order to prevent a labor to rewinding the transfer tape, stopping members which are made of thick paper and which can be inserted into core portions of the supply reel and the winding reel are inserted and the refill is in circulation. It is also conceived to provide the refill with stopping means, and to provide the case which holds the refill with a releasing-engaging portion which can engage a stopping-releasing portion of the stopping means. See, for example, Japanese Patent Application Laid-open No. 2001-71689 and No. 2005-28670.

When a refill in which stopping members capable of inserting into the supply reel and the winding reel are inserted into core portions of the supply reel and the winding reel is put into circulation, the stopping member is exposed outside of the refill in a region between the supply reel and the winding reel. Here, if the stopping member is made of thick paper, a portion of the stopping member exposed outside of the refill is damaged due to impact received during transportation, the supply reel or the winding reel rotates unnecessarily, and a labor for rewinding the transfer tape is generated in some cases. If the stopping member is made of material having high rigidity, it is necessary that the stopping member must be formed into such a shape that can be inserted into the core of the supply reel and the core of the winding reel and that connects the supply reel and the winding reel with each other. Therefore, the amount of necessary material is increased. Further, when the refill is provided with the stopping means, it is necessary to provide the case with a releasing-engaging portion that can engage the stopping-releasing portion of the stopping means, and it is difficult to commonly design the conventional refill and case.

SUMMARY OF THE INVENTION

The present invention is constituted to solve the above-described problem.

That is, the invention provides a transfer tool comprising a refill which has a supply reel and a winding reel around which a transfer tape is wound and which hold the transfer tool, and a support plate which rotatably supports the supply reel and the winding reel, wherein a stopping member is provided between the supply reel and the support plate or between the winding reel and the support plate such that the stopping member can be inserted and pulled out, and rotation of the supply reel or the winding reel is suppressed when the stopping member is disposed at a predetermined inserting position.

With this, it is possible to prevent the supply reel or the winding reel from being rotated due to a friction force generated between the supply reel and the stopping member disposed in the inserting position and a friction force generated between the stopping member and the support plate when the refill is alone put into circulation. That is, the unnecessary rotation of the supply reel or the winding reel when the refill is alone put into circulation can reliably prevented by the small stopping member. The stopping member is inserted between the supply reel and the support plate or between the winding reel and the support plate. Thus, it is unnecessary to change the design of other than the refill, and the number of portions having the common designs with respect to the conventional transfer tool can be increased.

To more reliably suppress the unnecessary rotation of the supply reel or the winding reel by the stopping member, the transfer tool may includes a stopping member holding portion which holds the stopping member in the inserting position.

As one mode capable of realizing the stopping member holding portion with a simple structure, a projection is provided on one of the stopping member and the support plate, a recess is formed in the other one of the stopping member and the support plate, and the stopping member holding portion engages the projection and the recess each other. According to this mode, a special part for retaining the stopping member in the inserting position is not required, and the number of parts is not increased.

To more reliably position the stopping member in the inserting position, the support plate includes a plate-like support plate body, and a supply reel support portion or a winding reel support portion projecting from the support plate body, and the stopping member includes a positioning portion which abuts against the supply reel support portion or the winding reel support portion in the inserting position.

In order to prevent an inconvenience such as cut of the transfer tape from occurring when the transfer tool which includes a pair of first and second cases capable of relatively moving between the use position and the open position, is used in the state that the supply of the transfer tape from the supply reel is restrained after the cases are moved to the use position in remaining the stopping member disposed in the inserting position, the stopping member includes a plate-like body which can be inserted in between the supply reel and the support plate or in between the winding reel and the support plate, and a knob projecting from one end of the body, and when the stopping member is disposed in the inserting position and the first and second cases relatively move, one of the cases abuts against the knob to limit further movement thereof toward the use position.

According to the structure of the transfer tool of the present invention, it is possible to prevent the supply reel or the winding reel from being rotated due to a friction force generated between the supply reel and the stopping member disposed in the inserting position and a friction force generated between the stopping member and the support plate when the refill is alone put into circulation. That is, the unnecessary rotation of the supply reel or the winding reel when the refill is alone put into circulation can reliably prevented by the small stopping member. The stopping member is inserted between the supply reel and the support plate or between the winding reel and the support plate. Thus, it is unnecessary to change the design of other than the refill, and the number of portions having the common designs with respect to the conventional transfer tool can be increased.

DETAILED DESCRIPTION OF THE PREFERRED EMBODIMENTS

An embodiment of the present invention will be explained with reference to the drawings.

Figure 1:
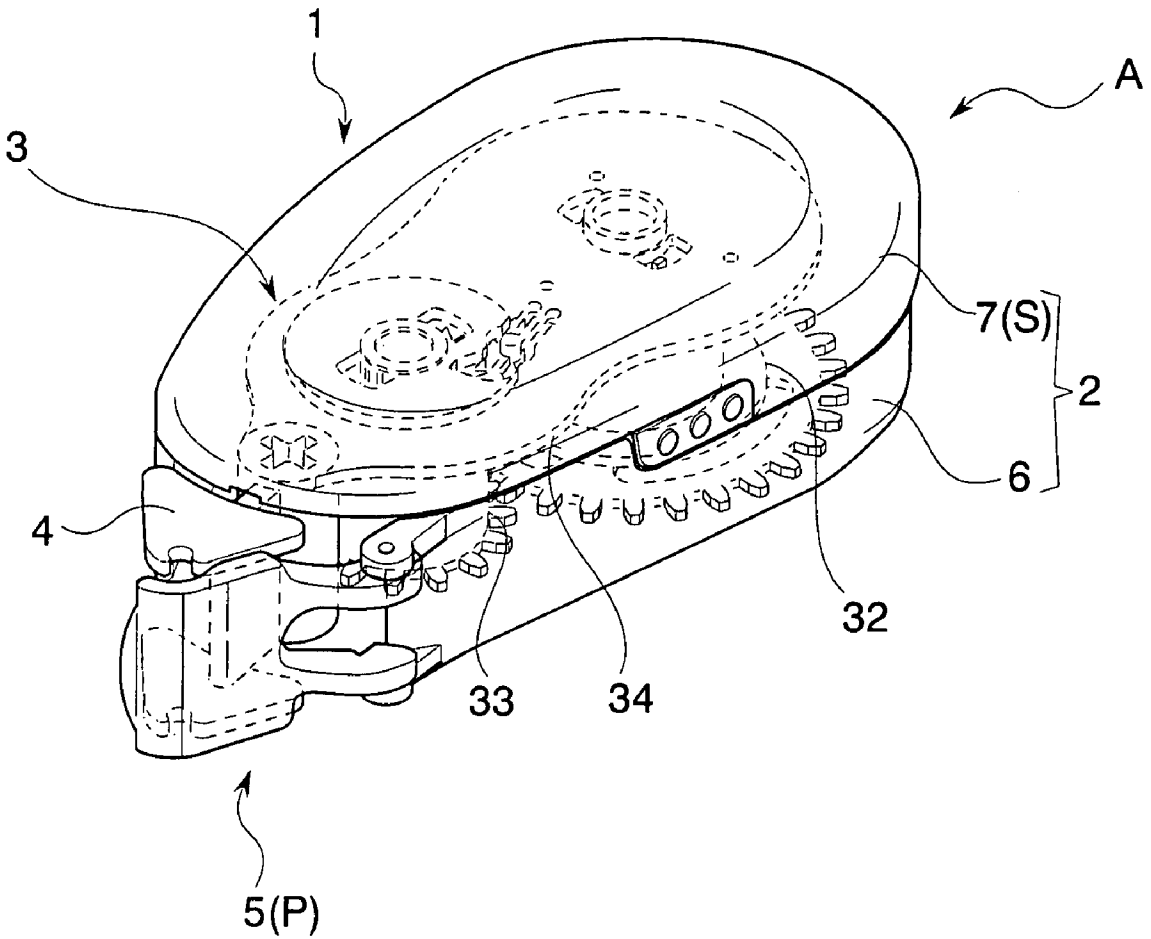
FIG. 1 is a perspective view of a state where a head cap of a transfer tool of an embodiment of the invention is disposed at a close position.
Figure 2:
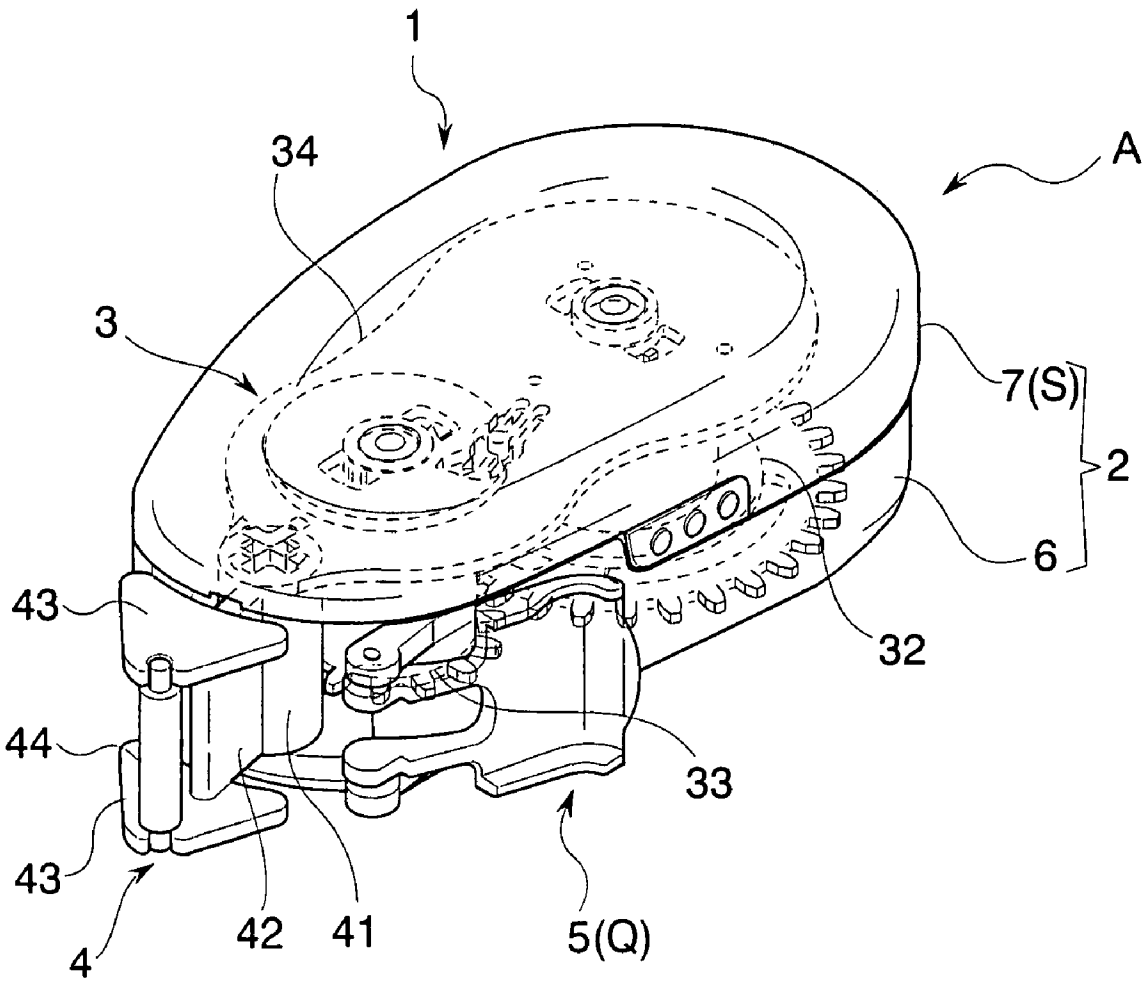
FIG. 2 is a perspective view of a state where the head cap of the transfer tool of the embodiment is disposed at an open position.
Figure 3:
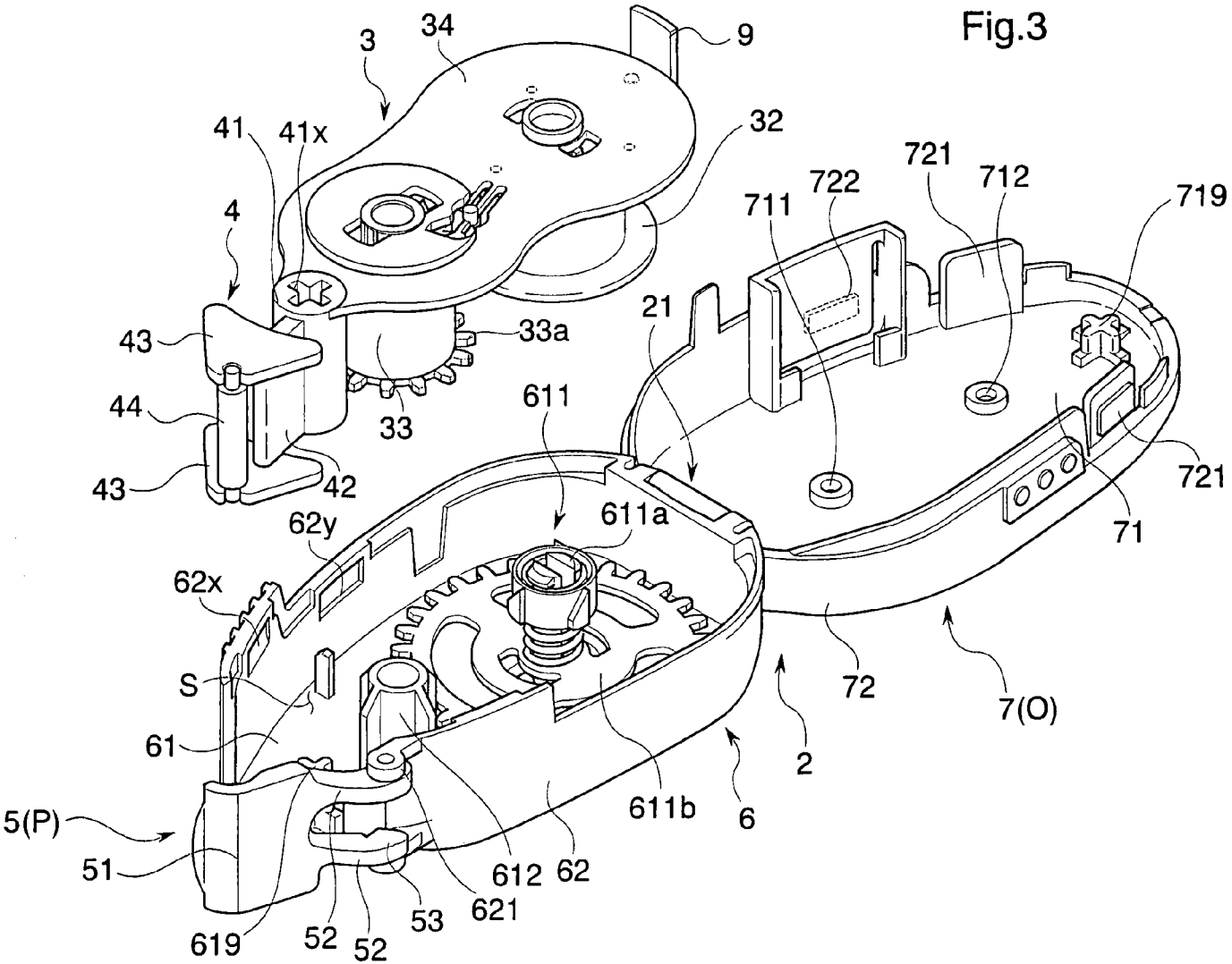
FIG. 3 is an exploded perspective view of the transfer tool of the embodiment.
Figure 4A:
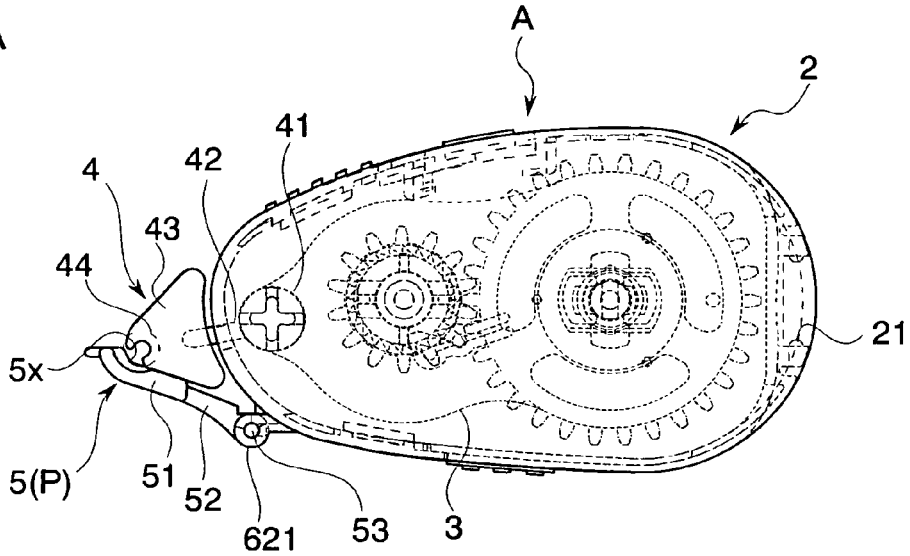
FIGS. 4A, 4B and 4C are a side view, a bottom view and a sectional view taken along a central vertical line of the transfer tool of the embodiment, respectively.
Figure 4B:
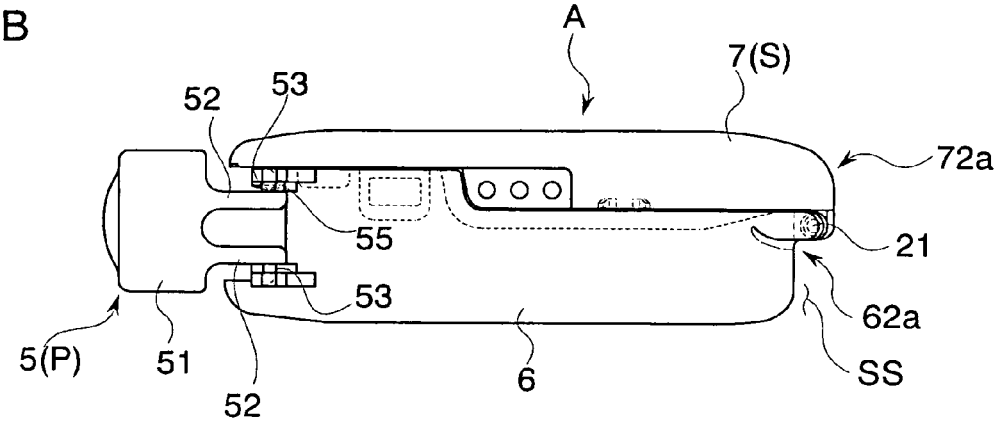
Figure 4C:
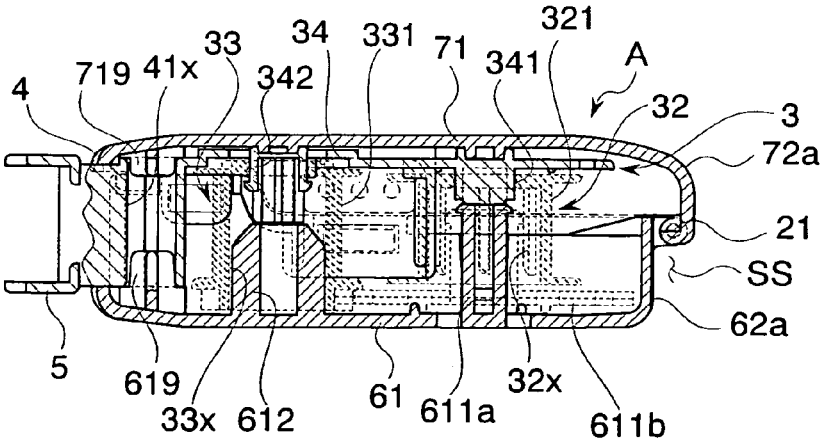

As shown in FIGS. 1 to 5, a transfer tool A according to the embodiment includes a transfer tool body 1 having a case portion 2 and a refill 3 which can hold the case portion 2, a transfer head 4 which is held by the transfer tool body 1, more specifically by the refill 3, and a head cap 5 which is pivotally attached to the transfer tool body 1, more specifically to the case portion 2. FIG. 1 is a perspective view of a state where the head cap 5 of the transfer tool A is disposed in a later-described close position P. FIG. 2 is a perspective view of a state where the head cap 5 of the transfer tool A is disposed in a later-described open position Q. FIG. 3 is an exploded perspective view of the transfer tool A. FIG. 4A is a side view of the transfer tool A, FIG. 4B is a bottom view of the transfer tool A, and FIG. 4C is a vertical sectional view taken along the center of the transfer tool A.

Parts constituting the transfer tool A will be explained below. In the following explanation, unless otherwise specified, "front" means a side where the transfer head 4 exists and "back" means a side opposite from the transfer head 4. An example of a transferring object is paste, or a correcting ink coating film or the like for correcting a character or a figure written or printed on a paper sheet or a film which is an object to be transferred.

As described above, the transfer tool body 1 includes the case portion 2 and the refill 3 which is detachably held in the case portion 2. The case portion 2 includes a first case 6, a second case 7 which pairs off with the first case 6, and a hinge 21 which connects the first and second cases 6 and 7 such that they can relatively move between a use position S and an open position O.

Figure 5:
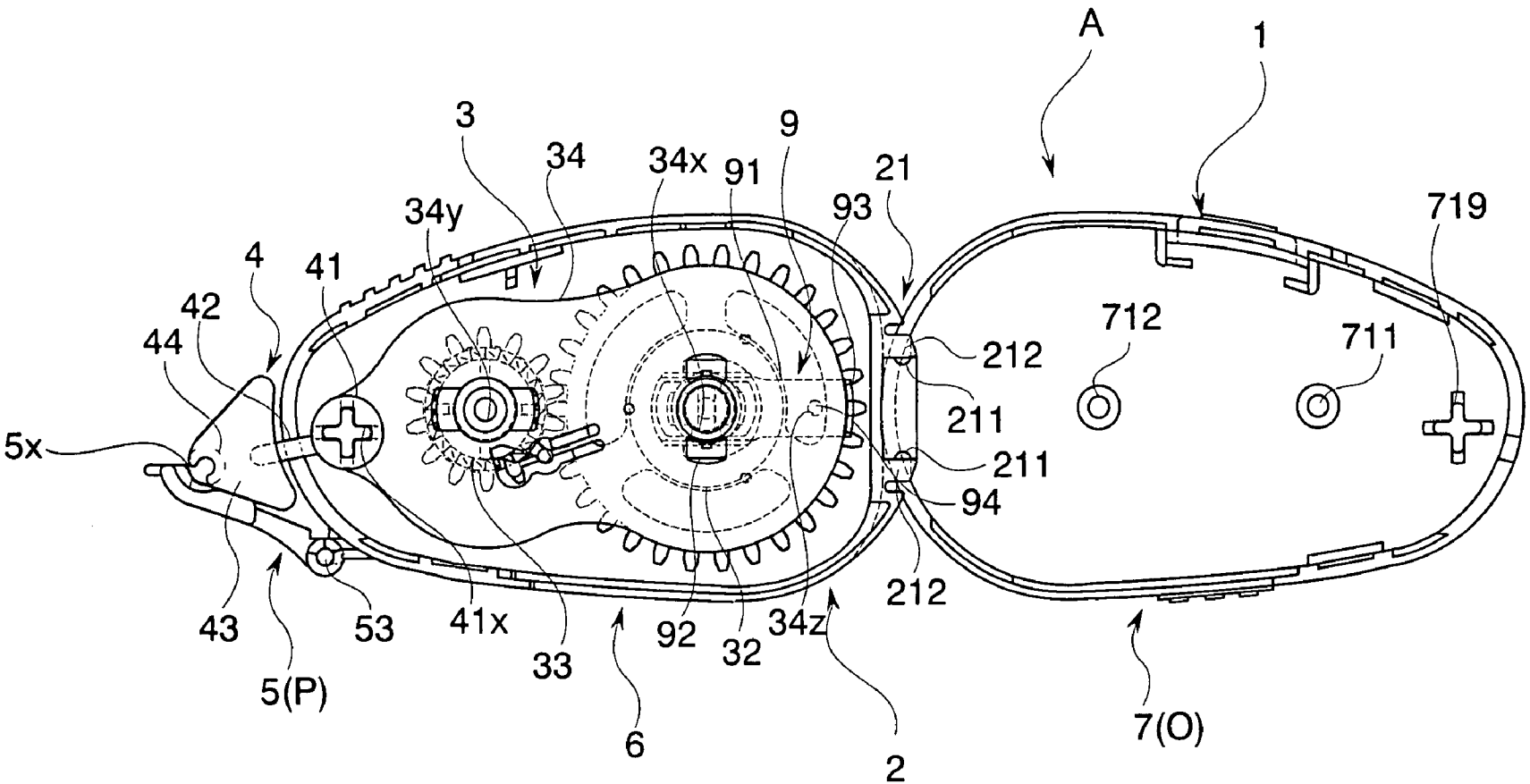
FIG. 5 is a side view of a state where first and second cases of the transfer tool of the embodiment are relatively moved to the open position.
Figure 6A:
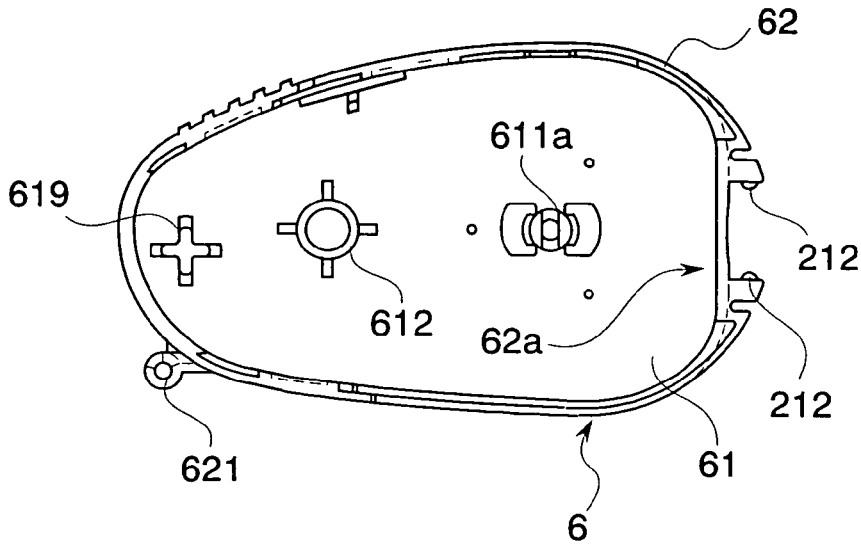
FIGS. 6A, 6B and 6C are a side view, a bottom view and a sectional view taken along a central vertical line of the first case of the transfer tool of the embodiment, respectively.
Figure 6B:
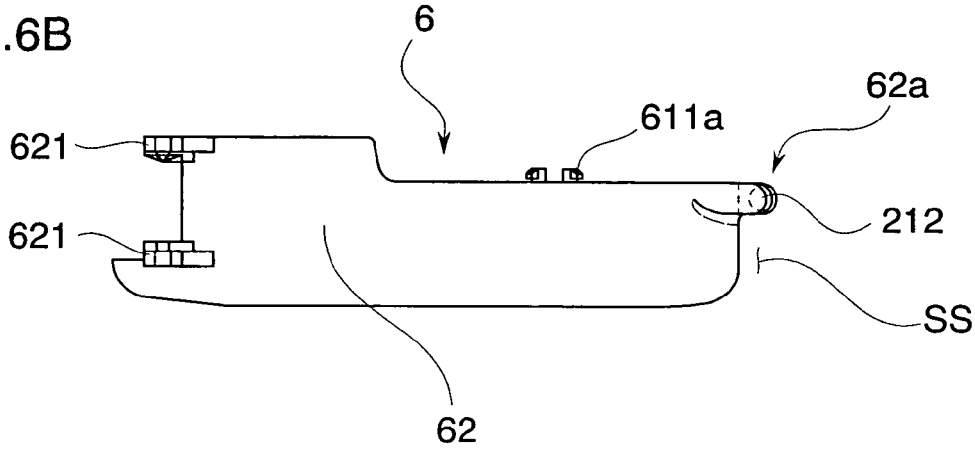
Figure 6C:
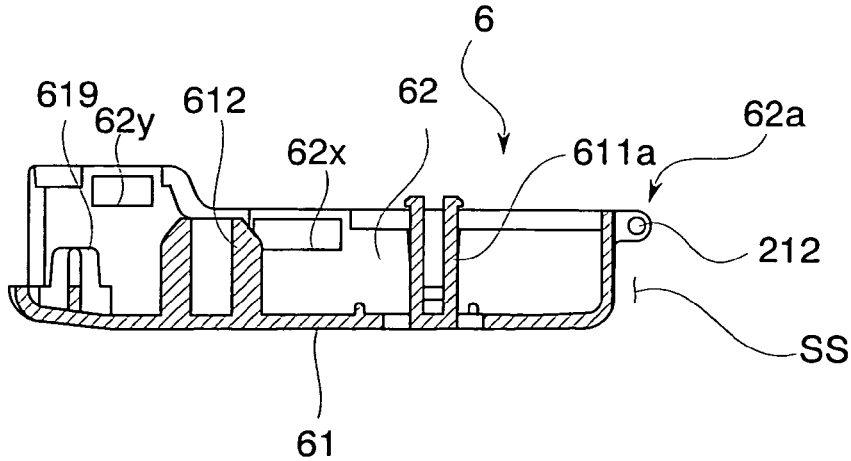

Constituent parts of the case portion 2 will be explained in more detail. As shown in FIG. 6, the first case 6 includes a main wall 61 forming a main body of the first case 6, and an outer wall 62 which is integrally formed on the main wall 61 and which surrounds the main wall 61. In the first case 6, a refill accommodation space S in which the refill 3 can be accommodated is formed. The refill accommodation space S is defined by the main wall 61 and the outer wall 62. FIG. 5 is a side view of a state where the first and second cases 6 and 7 of the transfer tool A of the embodiment are relatively moved to the open position O. FIGS. 1, 2 and 4 show a state where the first and second cases 6 and 7 are relatively moved to the use position S. FIG. 6A is a side view of the first case 6, FIG. 6B is a bottom view of the first case 6 and FIG. 6C is a sectional view taken along the center of the first case 6.

The main wall 61 is provided therein with a supply reel mounting portion 611 for rotatably mounting a supply reel 32 of the refill 3, and a winding reel mounting portion 612 for rotatably supporting a winding reel 33 of the refill 3. The supply reel mounting portion 611 includes a supply reel support portion 611*a* which can rotate together with the supply reel 32 if the supply reel support portion 611*a* is inserted into a later-described meshing hole (not shown) of the supply reel 32, and a drive gear 611*b* which is coaxially mounted on the supply reel support portion 611*a* through a slide mechanism (not shown) The winding reel mounting portion 612 is integrally formed from the main wall 61 into a substantially cylindrical shape, and the winding reel mounting portion 612 can be inserted into a later-described winding reel mounting hole (not shown) formed in a tip end of the winding reel 33.

The outer wall 62 projects from a portion of the outer edge of the main wall 61 except the front end. The rear end of the outer wall 62 is formed as a hinge corresponding portion 62*a* to provide the hinge 21 on the rear end of the outer wall 62. An outer peripheral surface of the hinge corresponding portion 62*a* is continuous with an outer peripheral surface of other portion of the outer wall 62. The transfer head 4 passes through a head-exposing opening and is exposed outside. The head-exposing opening is a portion where the outer wall 62 is not provided.

Figure 7A:
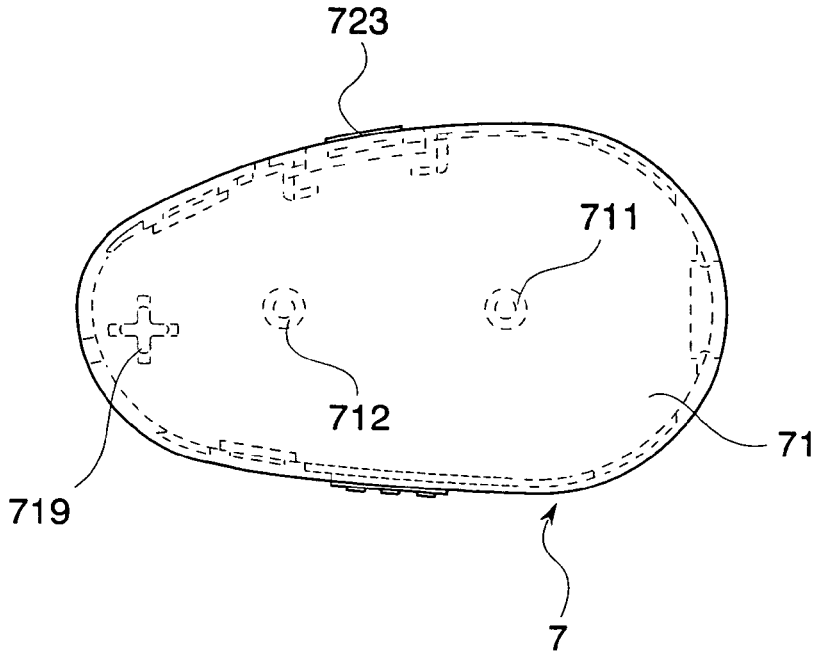
FIGS. 7A, 7B and 7C are a side view, a bottom view and a sectional view taken along a central vertical line of the second case of the transfer tool of the embodiment, respectively.
Figure 7B:
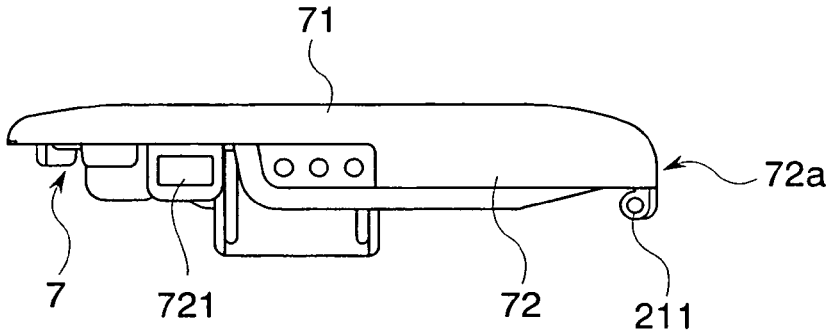
Figure 7C:
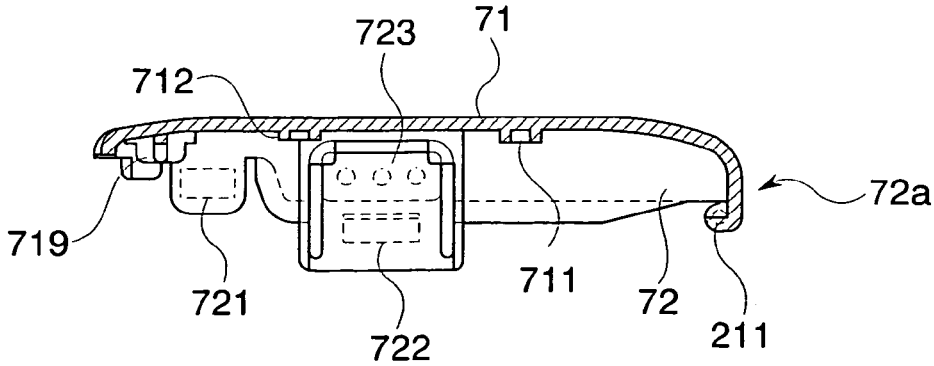

As shown in FIG. 7, the second case 7 includes a lid 71 which substantially closes the refill accommodation space S of the first case 6, and an outer wall 72 which projects from an outer edge of the lid 71 and its projecting end is overlapped on an outer wall 62 of the first case 6. FIG. 7A is a side view of the second case 7, FIG. 7B is a bottom view of the second case 7 and FIG. 7C is a vertical sectional view taken along the center of the second case 7.

The lid 71 is formed with insertion projections 711 and 712 which can be fitted into supported holes 34*x* and 34*y* formed in a support plate 34 at two locations corresponding to centers of the supply reel 32 and the winding reel 33.

To provide the hinge 21 on the rear end of the outer wall 72, the rear end of the outer wall 72 is formed as a hinge corresponding portion 72*a*. An outer peripheral surface of the hinge corresponding portion 72*a* is continuous with an outer peripheral surface of the other portion of the outer wall 72.

Front engaging part and rear engaging part are provided between the first case 6 and the second case 7 to realize a reliable engagement between the first and second cases 6 and 7. The front engaging part engages a front engaging recess 62*x* formed in a front portion of the outer wall 62 of the first case 6 and a front engaging pawl 721 provided on the outer wall 72 of the second case 7 at a location where a position thereof in the longitudinal direction matches with the front engaging recess 62*x* in the use position S with each other. The rear engaging part engages a rear engaging recess 62*y* provided at a central portion of the outer wall 62 of the first case 6 in the longitudinal direction and a rear engaging pawl 722 with each other. The rear engaging pawl 722 is provided on a portion of the outer wall 72 of the second case 7 which matches with the rear engaging recess 62*y* in the use position S in the longitudinal direction. The rear engaging pawl 722 can move between an engaging position where the rear engaging pawl 722 engages with the rear engaging recess 62*y* and a separating position where the rear engaging pawl 722 is separated from the rear engaging recess 62*y*. An operating portion 723 is provided near the rear engaging pawl 722. If the operating portion 723 receives an operating force, the rear engaging pawl 722 elastically deforms and moves from the engaging position to the separating position.

As described above, the hinge 21 connects the first and second cases 6 and 7 with each other such that they can relatively move between the use position S and the open position O. In this embodiment, the hinge 21 is provided inward from an outer edge of the second case 7. More specifically, the hinge 21 is formed utilizing a shaft member 211 which projects from the second case 7, and a pair of bearings 212 and 212 provided in the first case 6 for pivotally supporting the shaft member 211 from both sides. An retraction space SS which can receive the second case 7 is provided in an open position Q near the hinge 21 of the first case 6, preferably in front of the bearings 212 and 212.

The transfer tool A of the embodiment further includes a transmission mechanism which is provided between the first case 6 and the refill 3 for transmitting rotation of the supply reel 32 to the winding reel 33.

The refill 3 is held between the first case 6 and the second case 7. The refill 3 includes the supply reel 32 which holds an unused transfer tape in a state, the unused transfer tape being wounded on the supply reel 32 in the state, the winding reel 33 around which a used transfer tape film is wound, and a support plate 34 which rotatably supports the supply reel 32 and the winding reel 33 and which integrally holds the transfer head 4.

The transfer head 4 can transfer a transferring object provided on a transfer tape to an object to be transferred. In this embodiment, the transfer head 4 is supported by the refill 3, and the refill 3 and the transfer head 4 are integrally handled.

As shown in FIG. 4, the supply reel 32 includes a supply reel body 321 forming a main body of the supply reel 32, and a meshing hole 32*x* which can accommodate the supply reel 32 when a transfer tape is pulled out from the supply reel support portion 611*a* such that rotation of the supply reel 32 can be transmitted and the meshing hole 32*x* meshes with the supply reel support portion 611*a*.

As shown in FIG. 4, the winding reel 33 includes a winding reel body 331 forming a main body of the winding reel 33, a winding reel mounting hole 33*x* which can accommodate the winding reel mounting portion 612 such that the winding reel mounting hole 33*x* can rotate with respect to the winding reel mounting portion 63, and a follower gear 33*a* which is formed on a peripheral edge of the winding reel mounting hole 33*x* and which can mesh with the drive gear 611*b*. That is, in this embodiment, the supply reel support portion 611*a* and the drive gear 611*b* which constitute the supply reel mounting portion 611, and the follower gear 33*a* constitutes the transmitting mechanism.

As shown in FIG. 4, a front end of the support plate 34 supports a base end 41 of the transfer head 4 such that the base end 41 can not rotate. The support plate 34 is provided at its surface opposed to the first case 6 with a supply reel holding portion 341 and a winding reel holding portion 342 which rotatably hold the supply reel 32 and the winding reel 33, respectively. Supported holes 34*x* and 34*y* are formed in the surface of the support plate 34 opposed to the second case 7 at locations corresponding to centers of the supply reel 32 and the winding reel 33, respectively.

As shown in FIGS. 3 and 5, the transfer head 4 includes a base end 41 integrally formed on the support plate 34 of the refill 3, an extension plate 42 extending forward from the base end 41, restriction plates 43 and 43 formed on both-sides of the extension plate 42 as outer plates, and a transfer roller 44 which is rotatably supported by tip ends of the restriction plates 43 and 43 as folding back guide portion. The base end 41 is set such that the base end 41 can slightly deform when the transfer head 4 which is being used is pressed in this embodiment. The restriction plates 43 and 43 are provided for stably moving the transfer tape while suppressing deviation of the transfer tape sideway and for transferring the transferring object to the object which is to be transferred. That is, a transfer tape passage is formed between the restriction plates 43 and 43. A surface of the transfer roller 44 is made of material which can elastically deform so as to press the transfer tape against the object to be transferred. An engaging portion which can prohibit the relative turning motion between the base end 41 and the case portion 2 (i.e., first case 6 and second case 7) is provided between the base end 41 of the transfer head 4, the first case 6 and the second case 7. This engaging portion is provided on the base end 41 of the transfer head 4, and engages a cross groove 41*x* opening in a width direction of the transfer tool A and cross ribs 619 and 719 provided on the first case 6 and the second case 7 with each other.

The head cap 5 is pivotally supported by the first case 6 through the pivot shaft 53. The head cap 5 can turn between the close position P where the head cap 5 can cover a tip end of the transfer head 4 and an open position Q where the tip end of the transfer head 4, i.e., at least the restriction plates 43 and 43 and the transfer roller 44 are exposed.

More specifically, as shown in FIG. 9, the head cap 5 includes a cap body 51 which is opposed to a lower surface of the restriction plate 43 of the transfer head 4 in the close position P (surface to be opposed to an object to be transferred) and which cover a tip lower end of the transfer head 4, connecting arms 52 extending from both end edges of the cap body 51, and a pivot shaft portion 53 which is provided on an end of the connecting arm 52 and which is pivotally supported on a cap receiver 621 provided on the outer wall 62 of the first case 6. The head cap 5 is located outside of an inserting and pulling out locus of the transfer head 4 when the head cap 5 is disposed in the close position P. In this embodiment, the inserting and pulling out locus of the transfer head 4 is a locus of the transfer head 4 from a position where the transfer head 4 which is integrally constituted with the refill 3 is mounted on the first case 6 to a position where it is moved by the longitudinal size of the supply reel mounting portion 611, i.e., a projecting width from the main wall 61 in the pulling out direction. That is, the head cap 5 has a shape which is not overlapped on the transfer head 4 as viewed from side in the pulling out direction when the head cap 5 is disposed in the close position P. In other words, the head cap 5 can form a head inserting and pulling out space so that the transfer head 4 can move in the inserting and pulling out direction of the transfer head 4 in the pulling out direction of the transfer head 4. The head cap 5 includes a head accommodating recess 5*x* in which the transfer roller 44 of the transfer head 4 can be accommodated when the head cap 5 is disposed in the close position P. FIG. 9A is a right side view of the head cap 5, FIG.

Figure 9A:
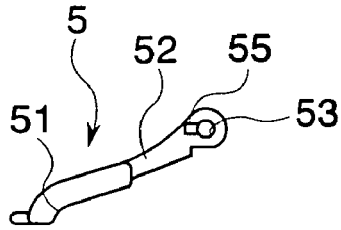
FIGS. 9A, 9B, 9C and 9D are a right side view, a bottom view, a plan view and a left side view of the head cap of the embodiment, respectively.
Figure 9B:
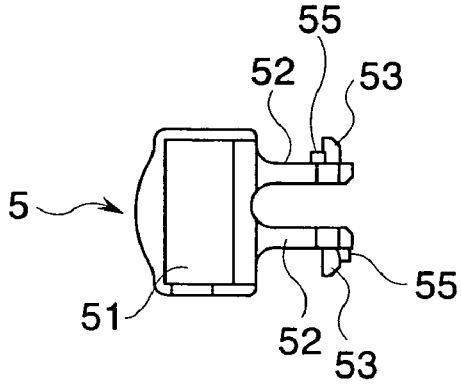
Figure 9C:
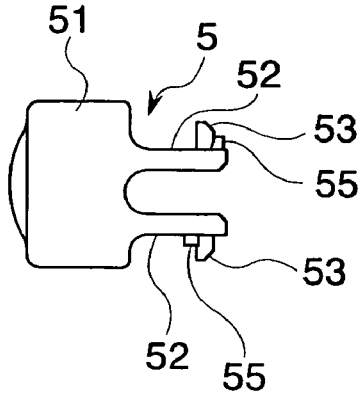
Figure 9D:
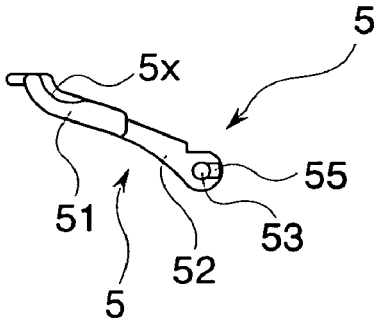

9B is a bottom view of the head cap 5, FIG. 9C is a plan view of the head cap 5 and FIG. 9D is a left side view of the head cap 5.

Figure 8A:
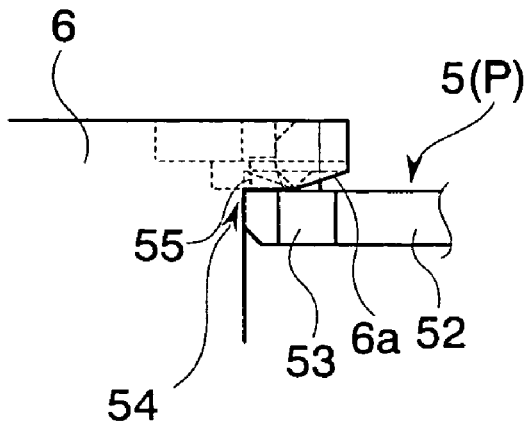
FIGS. 8A, 8B and 8C each is a view for explaining the action of a holding mechanism of the transfer tool of the embodiment.
Figure 8B:
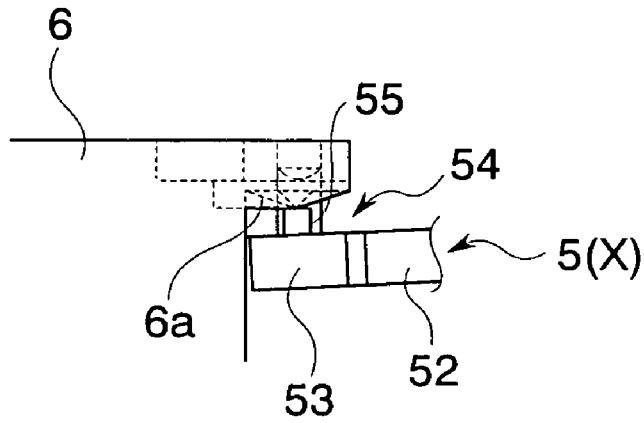
Figure 8C:
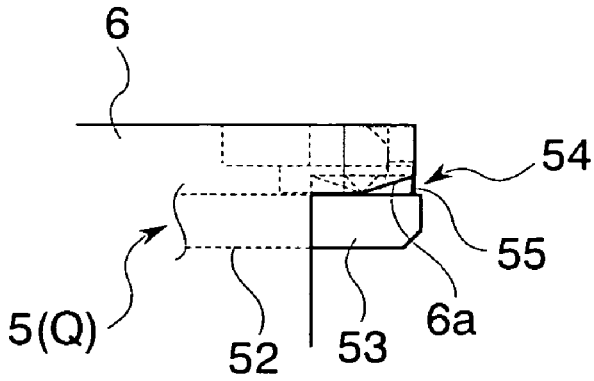

An urging mechanism 54 which selectively elastically urges the head cap 5 toward the close position P or the open position Q is provided in the vicinity of the pivot shaft portion 53 of the head cap 5. More specifically, as shown in FIG. 8, a projection 55 projects from the pivot shaft portion 53, and a cam face portion 6*a* which can slide on the projection 55 is provided adjacent to the bearing of the first case 6. The cam face portion 6*a* and the projection 55 slide on each other, the projection 55 and other connecting arm 52 provided on the pivot shaft portion 53 are elastically deformed, and they move toward the other connecting arm 52. The cam face portion 6*a* has only one dead point X at which a distance between the dead point X and the axis of the pivot shaft portion 53 becomes minimum and the moving amount of the connecting arm 52 becomes maximum when the head cap 5 is located at an intermediate location between the close position P and the open position Q. The cam face portion 6*a* urges the head cap 5 toward the close position P if the head cap 5 is closer to the close position P, and toward the open position Q if the head cap 5 is closer to the open position Q. FIG. 8A shows a state where the head cap 5 is disposed in the close position P, FIG. 8B shows a state where the head cap 5 is disposed at the dead point X, and FIG. 8C shows a state where the head cap 5 is disposed in the open position Q.

Figure 10A:
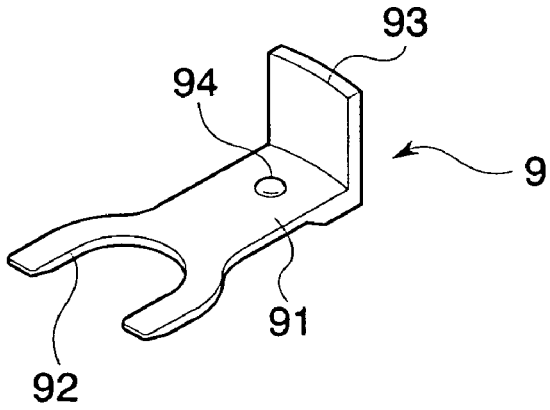
FIGS. 10A, 10B, 10C and 10D are a perspective view, a front view, a side view and a plan view of a stopping member of the embodiment, respectively.
Figure 10B:
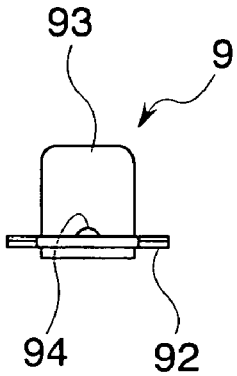
Figure 10C:
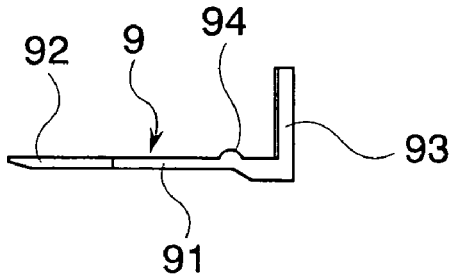
Figure 10D:
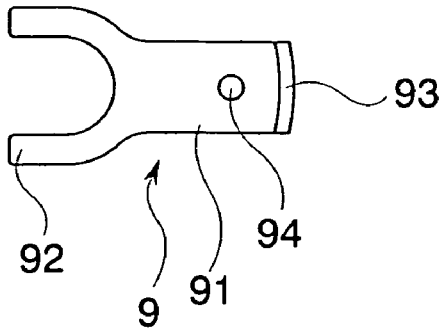

In addition, a stopping member 9 can be inserted and pulled out between the supply reel 32 and the support plate 34 to prevent the supply reel 32 from rotating when the refill 3 is transported alone. As shown in FIG. 10, the stopping member 9 includes a stopping body 91 inserted between the supply reel 32 and the support plate 34, an abutting portion 92 which is provided on one end of the stopping body 91 and which abuts against the supply reel support portion 611*a* of the first case 6 when the stopping member 9 is disposed to a predetermined inserting position, a knob 93 which is provided on the other end of the stopping body 91 and which projects toward the second case 7 in a state where the refill 3 is mounted on the first case 6, and a projection 94 which is provided on one surface of the stopping body 91 and which can be engaged with an engaging recess 34*z* formed in the support plate 34 when the stopping member 9 is disposed in the predetermined inserting position. FIG. 10A is a perspective view of the stopping member 9, FIG. 9B is a front view of the stopping member 9, FIG. 10C is a side view of the stopping member 9 and FIG. 10D is a plan view of the stopping member 9.

As described above, the transfer tool A of the invention includes the refill 3 having the supply reel 32 and the winding reel 33 around which transfer tapes are wound and which holds the transfer tapes, and the support plate 34 which rotatably supports the supply reel 32 and the winding reel 33. The stopping member 9 is provided such that it can be inserted and pulled out in and from between the supply reel 32 and the support plate 34, and rotation of the supply reel 32 or the winding reel is suppressed when the stopping member 9 is disposed in a predetermined inserting position. Therefore, when the refill 3 is alone put into circulation, the stopping member 9 is less prone to be pulled out from the refill 3 due to a friction force generated between the supply reel 32 and the stopping member 9 disposed in the inserting position and between the stopping member 9 and the support plate 34, and rotation of the supply reel 32 can be suppressed more reliably. That is, unnecessary rotation of the supply reel 32 when the refill 3 is alone put into circulation can be suppressed.

Since the transfer tool has a stopping member holding portion H which holds the stopping member 9 at the inserting position, it is more difficult to pull the stopping member 9 out from the refill 3, and the unnecessary rotation of the supply reel 32 can be suppressed by the stopping member 9 more reliably.

Since the stopping member holding portion H engages the projection provided on the support plate 34 and the recess formed in the stopping member 9 such that it can engage with projection with each other, a special part for retaining the stopping member 9 at the inserting position is not required, and the stopping member holding portion H can be realized with a simple structure without increasing the number of parts.

In addition, the support plate 34 includes a plate-like support body 341 and a supply reel support portion 342 projecting from the support body 341. The stopping member 9 includes a positioning portion 92 which abuts against the supply reel support portion 342 at the inserting position. Therefore, it is possible to more reliably position the stopping member 9 at the inserting position.

The transfer tool further includes the pair of first case 6 and second case 7. The first and second cases 6 and 7 can relatively move between the use position S and the open position O, the stopping member 9 includes a plate-like body 91 which can be inserted between the supply reel 32 and the support plate 34, and the knob 93 projecting from one end of the body 91. When the stopping member 9 is disposed at the inserting position and the first and second cases 6 and 7 are relatively moved, the second case 7 abuts against the knob 93 to limit further movement of the second case 7 toward the use position S. It is possible to prevent an inconvenience that the first and second cases 6 and 7 are moved to the use position S in a state where the stopping member 9 is disposed at the inserting position, the supply of the transfer tape from the supply reel 32 is suppressed and in this state, the transfer tool A is used and the transfer tape is cut.

The present invention is not limited to the above-described embodiment.

Although the stopping member is inserted between the supply reel and the support plate in the embodiment, the stopping member may be inserted between the winding reel and the support plate.

A stopping member holding portion using pin insertion holes formed in the stopping member and the support plate such that the holes can be superposed on each other and engaging pins inserted into the pin insertion holes may be employed. The stopping member holding portion can also have a function as the positioning portion which positions the stopping member on the inserting position.

In addition, instead of providing the stopping member holding portion for holding the stopping member at the inserting position, an elastic force caused when the support plate is elastically deformed is used while setting the thickness of the stopping body at the maximum level within such a range that it can be inserted between the supply reel and the support plate or between the winding reel and the support plate, a bumpy surface is provided substantially in the entire region of a surface of the stopping body, a friction coefficient between the supply reel and the support plate or between the winding reel and the support plate is increased so as to prevent the stopping member from being pulled out.

When both the support plate of the refill and the second case fitted to the support plate are transparent and the stopping member is opaque, if a structure for avoiding a case in which the transfer tool is erroneously used in a state where the stopping member is mounted on the refill, the knob may be omitted.

Various modifications may be made within a range not departing from the subject matter of the invention.

What is claimed is:

1. A transfer tool comprising:

a refill which includes:

a supply reel;

a winding reel around which a transfer tape is wound and which holds the transfer tool; and a support plate which rotatably supports the supply reel and the winding reel; and a stopping member which is insertably and retractably provided between a periphery of the supply reel in an axial direction of the supply reel and the support plate or between a periphery of the winding reel in an axial direction of the winding reel and the support plate, wherein rotation of the supply reel or the winding reel is suppressed when the stopping member is disposed at a predetermined inserting position, and wherein a friction force generated between the stopping member and an axial direction end portion of the supply reel or an axial direction end portion of the winding reel, and between the stopping member and the support plate prevents the supply reel or the winding reel, respectively, from rotating.

2. The transfer tool according to claim 1, further comprising a stopping member holding portion which engages the stopping member with the support plate and holds the stopping member at the inserting position.

3. The transfer tool according to claim 2, wherein a projection is provided on one of the stopping member and the support plate, a recess is formed in the other one of the stopping member and the support plate, and the projection and the recess engage each other.

4. The transfer tool according to claim 3, wherein the support plate includes a substantially planar support plate body, and a supply reel support portion or a winding reel support portion projecting from the support plate body, and wherein the stopping member includes a positioning portion which abuts against the supply reel support portion or the winding reel support portion in the inserting position.

5. The transfer tool according to claim 4, further comprising:

a pair of a first case and a second case, wherein the first and second cases can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

6. The transfer tool according to claim 3, further comprising:

a pair of a first case and a second case, wherein the first and second cases can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

7. The transfer tool according to claim 2, wherein the support plate includes a substantially planar support plate body, and a supply reel support portion or a winding reel support portion projecting from the support plate body, and wherein the stopping member includes a positioning portion which abuts against the supply reel support portion or the winding reel support portion in the inserting position.

8. The transfer tool according to claim 7, further comprising:

a pair of a first case and a second case, wherein the first and second cases can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

9. The transfer tool according to claim 2, further comprising:

a pair of a first case and a second case, wherein the first and second cases can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

10. The transfer tool according to claim 1, wherein the support plate includes a substantially planar support plate body, and a supply reel support portion or a winding reel support portion projecting from the support plate body, and wherein the stopping member includes a positioning portion which abuts against the supply reel support portion or the winding reel support portion in the inserting position.

11. The transfer tool according to claim 10, further comprising:

a pair of a first case and a second case, wherein the first and second cases can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

12. The transfer tool according to claim 1, further comprising:

a pair of a first case and a second case, wherein the first case and second case can relatively move between a use position and an open position, wherein the stopping member includes a substantially planar body which can be inserted in between the supply reel and the support plate or in between the winding reel and the support plate, and a knob projecting from one end of the body, and wherein, when the stopping member is disposed in the inserting position and the first and second cases relatively move, one of the cases abuts against the knob to limit further movement thereof toward the use position.

13. The transfer tool according to claim 1, wherein an end portion of the stopping member comprises a U-shaped end portion.

14. The transfer tool according to claim 13, wherein the U-shaped end portion of the stopping member extends around the supply reel or the winding reel if the stopping member is inserted between a periphery of the supply reel in an axial direction of the supply reel and the support plate or between a periphery of the winding reel in an axial direction of the winding reel and the support plate.

15. The transfer tool according to claim 1, wherein the stopping member further comprises:

a main body;

an open-ended U-shaped end portion on a distal end of the main body; and a knob on an other distal end of the main body, wherein the knob extends perpendicularly away from the main body, and wherein a projection is formed on a portion of the main body.

16. The transfer tool according to claim 15, wherein if the stopping member is in an inserted position, then the projection mates with a recess formed on the support plate.

17. The transfer tool according to claim 15, wherein the projection is formed in a center portion, centered in a direction perpendicular to an axis running from the knob to the open-ended U-shaped end portion.

18. The transfer tool according to claim 1, wherein the transfer tool further comprises a case body and the refill comprises a shape for mating with the case body.

19. The transfer tool according to claim 1, wherein the supply reel and the winding reel are attached to the support plate on a common side of the support plate.

20. The transfer tool according to claim 1, wherein the stopping member is insertably and retractably attached in a direction perpendicular to the axis of the supply reel or the winding reel.

* * * * *